United States Patent [19]

King

[11] 4,150,382

[45] Apr. 17, 1979

[54] NON-UNIFORM VARIABLE GUIDED WAVE ANTENNAS WITH ELECTRONICALLY CONTROLLABLE SCANNING

[75] Inventor: Ray J. King, Madison, Wis.

[73] Assignee: Wisconsin Alumni Research Foundation, Madison, Wis.

[21] Appl. No.: 619,410

[22] Filed: Oct. 3, 1975

Related U.S. Application Data

[63] Continuation-in-part of Ser. No. 397,082, Sep. 13, 1973, abandoned.

[51] Int. Cl.[2] ..... H01Q 3/26

[52] U.S. Cl. ..... 343/754; 343/100 SA; 343/785; 343/854

[58] Field of Search ..... 343/754, 785, 853, 854, 343/100 SA

[56] References Cited

U.S. PATENT DOCUMENTS

| | | | |
|---|---|---|---|
| 3,094,664 | 6/1963 | Kibler | 343/785 |
| 3,160,887 | 12/1964 | Broussaud et al. | 343/777 |
| 3,259,902 | 7/1966 | Malech | 343/753 |
| 3,496,569 | 2/1970 | Alsberg et al. | 343/754 |
| 3,524,151 | 8/1970 | Safran | 333/6 |
| 3,978,484 | 8/1976 | Collier | 343/754 |

*Primary Examiner*—Eli Lieberman

*Attorney, Agent, or Firm*—Burmeister, York, Palmatier, Hamby & Jones

[57] ABSTRACT

The present invention makes it possible to provide a guided wave antenna having a radiation pattern which can be controlled electronically, by control signals derived from a computer or any other suitable source. In this way, the directional characteristics of the antenna can be adjusted and/or scanned rapidly, without any mechanical manipulation of the antenna. In one embodiment, a guided radio wave is launched along an antenna surface having an array of elements which provide variable non-uniform surface impedance adapted to be controlled by electronic signals. For example, each variable impedance element may comprise a wave guide section having one end leading from the antenna surface. Each wave guide section may include a solid-state electronic reflection amplifier having charcteristics which can be varied by supplying control signals to the amplifier, to vary the magnitude and phase angle of the wave reflected from the reflection amplifier. By changing the control signals supplied to any particular reflection amplifier, it is possible to cause attenuation or amplification and phase shift of the guided wave as it passes across the particular wave guide section. A wide variety of solid-state electronic control elements may be provided along one or more surfaces of the antenna. In another embodiment, a wave traveling in a closed subsurface wave guide is coupled into the guided wave open surface structure, using an array of wave guide elements containing electronically controllable amplifiers and phase shifters.

16 Claims, 9 Drawing Figures

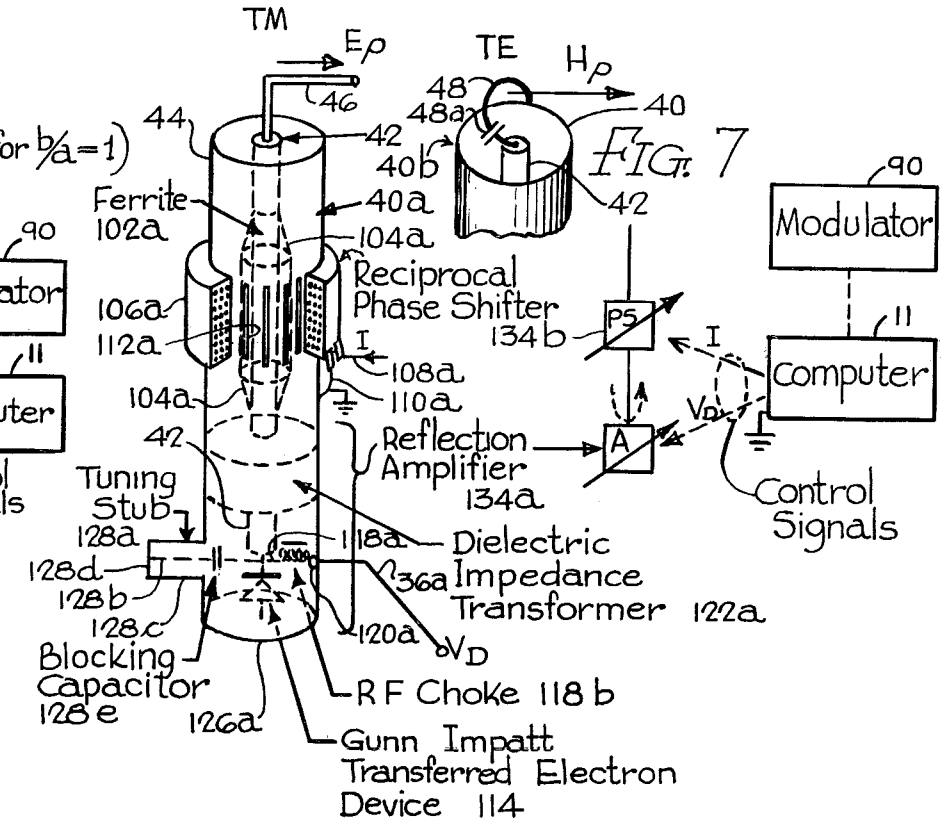
FIG. 6
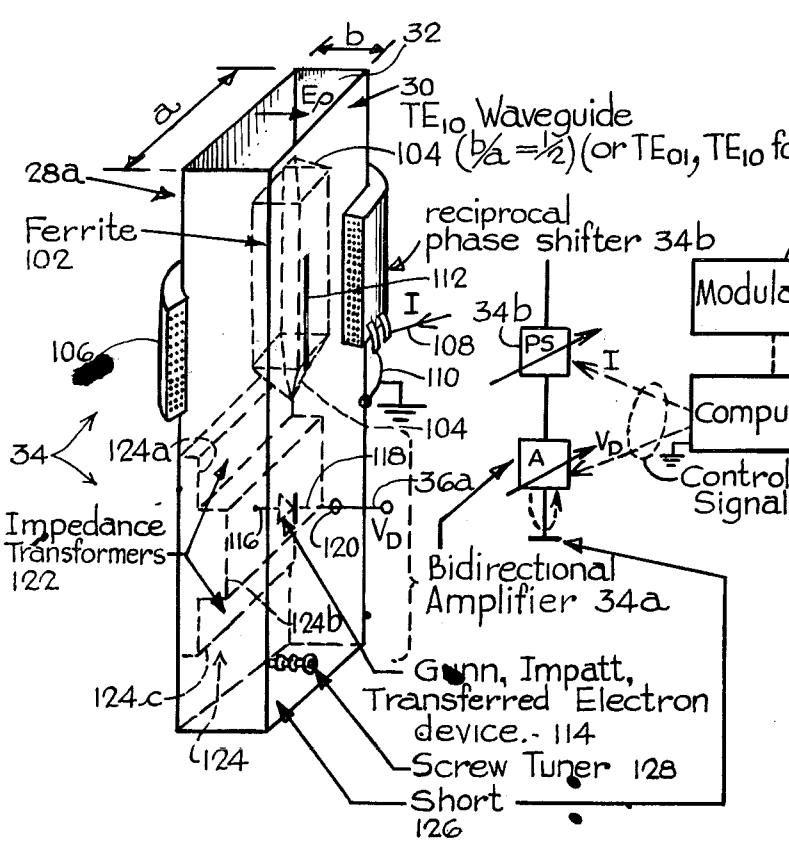
FIG. 5
FIG. 7

NON-UNIFORM VARIABLE GUIDED WAVE ANTENNAS WITH ELECTRONICALLY CONTROLLABLE SCANNING

The invention described herein was made in the course of or under a grant from the National Science Foundation, an agency of the United States Government.

This application is a continuation-in-part of my copending application, Ser. No. 397,082, filed Sept. 13, 1973, now abandoned.

This invention relates to directional guided wave radio antennas particularly for microwave and millimeter wave applications.

One object of the present invention is to provide a new and improved directional guided wave antenna having electronically controllable means for rapidly and easily changing the radiation pattern of the antenna for either transmission or reception so that the directional characteristics of the antenna can be scanned or otherwise varied by supplying electronic control signals to the antenna, without any mechanical manipulation of the antenna or its associated feed system.

Another object is to provide a new and improved guided wave antenna for which the shape of the radiation or receiving pattern can be adjusted electronically to suit the requirements of a radar system or any other microwave radiation system.

A further object is to provide a new and improved guided wave antenna having a multiplicity of electronically controllable elements distributed over a surface along which a guided wave is propagated, so that the impedance characteristics of the surface can be varied to produce either a uniform surface impedance, or any desired non-uniform pattern of surface impedance, with the result that the guided wave can be steered, amplified, attenuated or shaped in a selective manner, whereby the radiation pattern of the antenna can be varied electronically for either transmission or reception, or both.

Another object is to enhance the directivity of the main directional beam produced by the guided wave antenna so that the main beam predominates greatly over the minor side lobes which are unavoidably produced by the antenna. In accordance with the present invention, this may be accomplished by launching the surface or guided wave with optimum efficiency and then utilizing the controllable elements of the antenna to produce a non-uniform surface which is capable of amplifying the surface wave as it travels along the surface. The energy of the amplified surface wave is then radiated in a controlled manner. In this way, the energy radiated from the surface greatly exceeds the spurious radiation due to energy which is not initially converted into the surface wave by the initial source of the energy and spurious radiation due to energy scattering by transitions such as the end of the antenna. Such spurious radiation causes undesirable radiation pattern characteristics such as beam widening and side lobes.

Another object is to provide a new and improved guided wave antenna in which the surface fields can be measured by electronically modulating the control signals to each of the controllable elements which are distributed over the controllable surface of the antenna. The field scattered from each modulated element can then be coherently detected back at the source to give the amplitude and phase of the surface field at that element. In turn, each element on the total surface can then be modulated to give the overall surface field, which can be used to compute the corresponding radiation pattern. Thus, the antenna is capable of being self-diagnostic in that its elements can be used to measure its own surface fields or, equivalently, its surface currents, so that its radiation pattern can be determined. All of this can be accomplished without any need to utilize auxiliary probes along the antenna, as has been necessary in the past.

Another object is to provide a new and improved guided wave antenna which has little or no protrusions on the surface on which it is mounted, and which can be electronically controlled to cause the directional characteristics to be scanned or otherwise varied without mechanical motion. Such an antenna is of considerable advantage on aerodynamic vehicles since it can be designed as part of the surface of the vehicle without affecting its aerodynamic properties.

The present invention generally comprises a guided wave antenna having one or more surfaces with surface impedance characteristics which can be varied electronically. The controllable surface of the antenna may be in the form of a plane or may have a simple or complex curvature, or any other suitable configuration such as that of a tapered rod, cone or the like. The controllable surface incorporates electronically controllable solid-state means, which may be continuous or may comprise an array of individually controllable discrete solid-state devices. Variable control signals for the individual solid-state devices may be provided by a suitably programmed computer or any other source.

The antenna provides means for launching a guided electromagnetic wave over the controllable surface. The wave may be launched by a single source or a plurality of correlated sources. By varying the impedance characteristics of the controllable surface, the propagation characteristics of the guided wave can be controlled. Thus, the direction of propagation, either away from or along the antenna surface, can be changed gradually at varying rates according to the electronic control signals applied to the solid-state elements. This manipulation of the electronic control signals can be employed to cause scanning of the overall antenna radiation pattern, either azimuthally or vertically.

In essence, the wave can be steered by the ensemble of individual variable elements as the wave propagates along the controllable surface. As the end of the antenna is approached, the remaining wave energy is either radiated from the antenna, dissipated in the surface, or reflected back along the surface; or is subject to various combinations of such radiation, dissipation and reflection. In most cases, it is preferred to radiate as much of the energy as possible in a prescribed direction.

In accordance with another feature of the present invention, the electronically controllable impedance elements of the antenna can be employed so that the antenna can be terminated gradually to minimize the waves reflected back along the surface. When a guided wave passes over an abrupt discontinuity in the surface impedance, spurious radiation and a reflected wave are produced which have an undesirable effect on the radiation pattern, especially in the backward direction. In the usual practice of the present invention, this gradual tapering of the surface impedance takes place over a distance less than one free space wavelength.

In one embodiment, the controllable surface comprises an array of wave guide elements leading from or coupled to the surface over which the wave to be controlled propagates. Each wave guide element comprises a solid-state electronics reflection amplifier having a gain (positive or negative) and phase shift which can be controlled by varying the control signals to the amplifier. Generally, it is preferred to control the gain and phase shift separately, by the use of two separate control signals. By varying the gain and/or phase shift of the reflection amplifier, the surface impedance presented at the aperture of the wave guide element can be varied in the complex impedance plane. By increasing the positive gain, for example, the inherent wave guide attenuation can be overcome. Further gain increases will cause energy to be added to the guided wave as it propagates over the open surface. The effective phase angle of the surface impedance element can also be varied. The magnitude and phase angle of the surface impedance determine the rate of amplification, attenuation, radiation, and the angle of propagation. By controlling the reflection amplifiers in a systematic manner, the direction of radiation can be scanned, as to either the azimuth or the angle of elevation relative to the controllable surface, or both. For azimuthal scanning, the surface impedance transverse to the direction of propagation is varied. Thus, azimuthal scanning of 360° can be obtained by using a circular array in a plane and a suitable source antenna.

The variable impedance surface can be terminated by providing a conductive surface of essentially zero impedance which will cause virtually complete radiation of the remainder of the wave.

In another embodiment, a wave is caused to travel in one or more closed subsurface wave guides and is coupled into the guided wave propagating over the open surface of the antenna by providing an array of wave guide elements extending between the subsurface wave guide and the open surface. Such wave guide elements contain electronically controllable amplifiers and phase shifters for individually controlling the amplitude and phase of the wave energy which is transmitted by each wave guide element to the open surface. By varying the electronic control signals supplied to the amplifiers and phase shifters, the radiation pattern of the antenna can be scanned or otherwise varied.

Further objects, advantages and features of the present invention will appear from the following description, taken with the accompanying drawings, in which:

FIG. 5 is a diagrammatic perspective view of a modified embodiment, similar to the embodiment of FIG. 1.

FIG. 6 is a diagrammatic perspective view showing another embodiment, similar to the embodiment of FIG. 2.

FIG. 7 is a fragmentary diagrammatic perspective view showing another modified embodiment, similar to the embodiment of FIG. 3.

Figures 1, 2, 3:
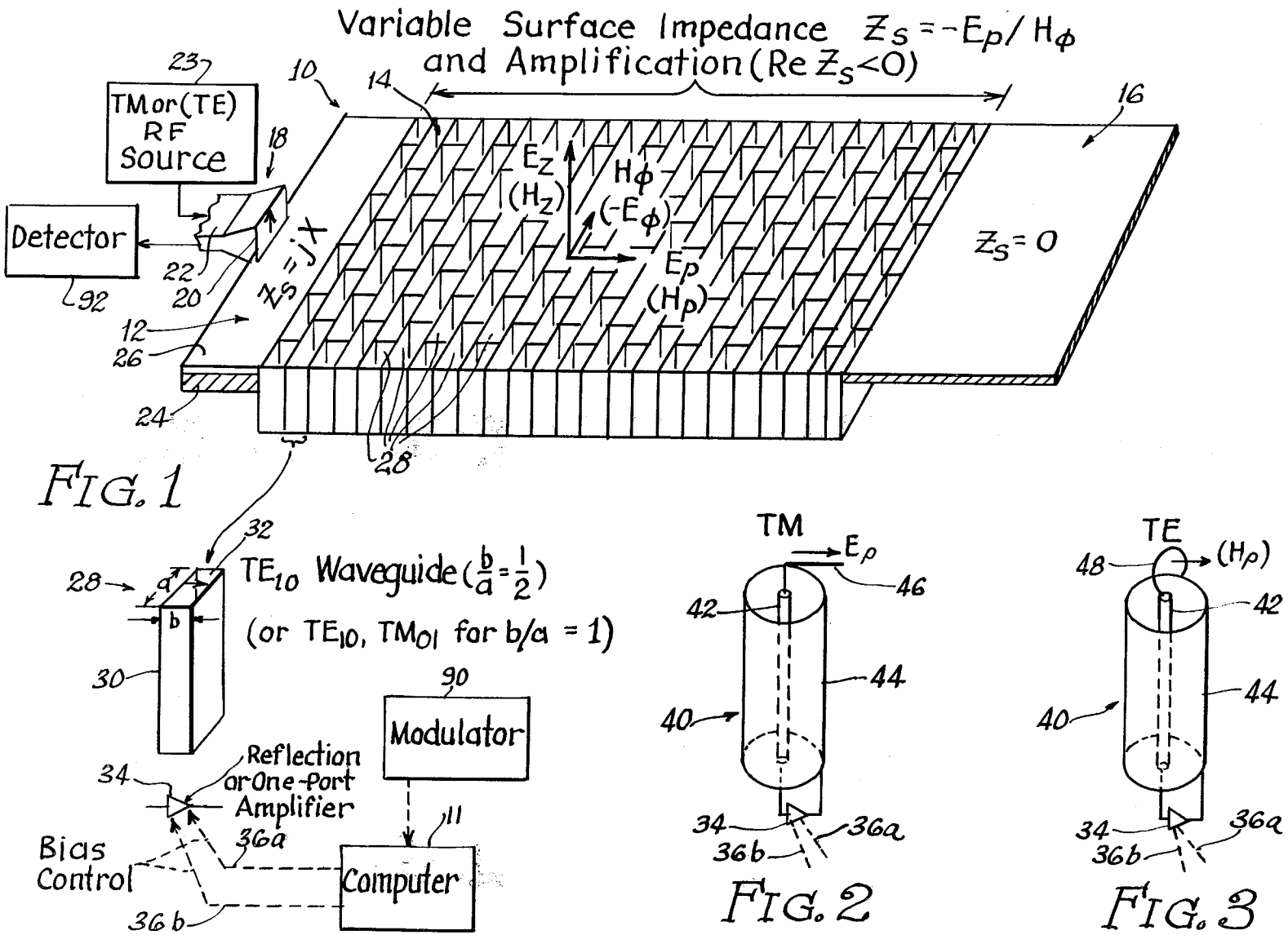
FIG. 1 is a diagrammatic perspective view showing an electronically controllable antenna to be described as an illustrative embodiment of the present invention.
FIGS. 2 and 3 illustrate modified or alternate wave guide elements for the antenna shown in FIG. 1, such wave guide elements being adapted for use with transverse magnetic (TM) and transverse electric (TE) waves, respectively, traveling along the controllable surface of the antenna.

It will be seen that FIG. 1 illustrates an electronically controllable guided wave antenna 10 having directional characteristics which are subject to control by signals from a computer 11 or the like. In this case, the various elements of the antenna are disposed along a plane. However, the elements of the antenna 10 may be formed into any suitable curvature or shape, as desired.

The illustrated antenna 10 comprises initial surface means 12, electronically controllable surface means 14, and terminating surface means 16. The antenna 10 also includes launching means 18 for launching a surface wave along the initial surface means 12 so that the wave will pass along the electronically controllable surface means 14 toward the terminating surface means 16.

As shown, the launching means 18 comprises a wave guide horn 20 connected to a wave guide 22 which receives radio frequency energy from a radio frequency source 23. Any other suitable means may be employed for directing radio frequency waves along the surface means 12, 14 and 16.

The wave traveling along the surfaces 12, 14 and 16 is either of the TM (Transverse Magnetic) mode, in which the magnetic field is totally transverse to the direction of propagation, or TE (Transverse Electric), where the electric field is totally transverse to the direction of propagation.

In the first case, the relevant variable is the surface impedance $Z_s$, which is defined as the ratio of $-E\rho/H\phi$ as shown in FIG. 1. The TE case is simply the dual obtained from the duality principal, and so the surface impedance becomes the surface admittance, $Y_s = +H\rho/H\phi$. These two types of waves can exist independently along the surface once they are launched, and are determined primarily by the nature of the exciting source. Normally, only one of these wave types will be propagated at a time even if the source generates both types, since the conditions desirable for propagation of a TM wave do not generally occur simultaneously for a TE wave. Through time-shared switching, it would be possible to propagate both types on a time-shared basis.

In the description, it should be understood that the "surface impedance" refers to the TM wave, and that the dual can be substituted using surface admittance in the TE case. In FIG. 1, the quantities in parentheses refer to the TE case.

Generally, it is desirable to construct the initial surface means 12 so that the traveling radio frequency waves will be propagated along the open surface as a non-radiating surface wave in a maximally efficient manner. To accomplish this end, the surface means 12 preferably has a surface impedance $Z_s$, which is purely inductive reactance of the order of $X = 60\pi$ ohms where $Z_s = jX$. As shown, the surface means 12 comprises a conductive metal slab 24 surmounted by a lossless or low-loss dielectric slab 26, although other configurations such as a corrugated surface may be used.

The intermediate surface means 14 presents a non-uniform surface impedance which is selectively variable under the control of electronic signals. In this case, the surface means 14 comprises an array of electronically controllable surface impedance elements 28. As shown, each element 28 comprises a wave guide section or element 30 which leads from the plane of the surface means 14. Thus, each wave guide section 30 has an open end 32 which is disposed in the plane of the surface means 14.

The guided ratio frequency wave, after being launched by the launcher 18 and after travelling along the first surface means 12, travels across the open ends or apertures 32 of the wave guide sections 30. Some of the traveling wave energy is coupled into each wave guide section 30. The energy is at least partially relected by a terminating reflection amplifier 34 in the wave guide section and thus is recombined with the guided wave above the surface 14. The reflection amplifier 34 is employed to vary the surface impedance presented at the aperture 32 of each wave guide section 30 by regulating the magnitude and phase angle of the wave reflected from the amplifier. It will be understood that the reflection amplifier 34 may be of any known or suitable construction.

The reflection amplifier 34 is usually a continuation of the guide section 30. The reflection amplifier 34 has one or more control lines or inputs adapted to receive control signals from the computer 11 or any other suitable source. In this case, there are two control inputs **36*a* and 36*b* for receiving control signals to regulate the gain and phase shift of the reflection amplifier 34**.

At negative and very low positive gain, the wave guide section 30 affords attenuation or absorption of wave energy. Such attenuation is decreased as the gain is increased. For higher positive gain settings, the wave guide section 30 adds energy to the guided wave above the surface 14. Thus, the reflection amplifier 34 is capable of causing the wave guide section 30 to present a negative component of resistance to the TM guided wave (or conductance as to a TE wave).

By increasing the gain of the reflection amplifiers 34 along a particular direction or pattern, the array of surface impedance elements 28 can be caused to steer the guided wave so that it is propagated in a particular direction. By systematically changing the pattern of the surface impedance over the antenna surface, the direction of the radiation can be scanned to carry out a searching operation, as in a search radar system, or for any other purpose.

A brief mathematical analysis of this point may be helpful. Thus, the approximate angle of radiation from the plane of the surface is $$\Psi = \cos^{-1} 1 - [(Re(\Delta^2)/2]$$

where $\Delta = Z_s/120\pi$. Thus, all portions of the surface 14 on which $Re(\Delta^2)$ is constant radiate in the same direction. The equation $$Re(\Delta^2) = \text{constant}$$

describes a family of hyperbolas which are symmetric about the negative real surface impedance axis. This then indicates that certain portions of surface 14 can be made to function as an amplifier which causes the guided wave to grow while other portions of surface 14 further disposed from the initial source 18 would cause attenuation of the guided wave, all portions of the surface 14 simultaneously radiating in the same direction. In this way the carefully controlled radiation from the total surface 14 can be made to greatly exceed any spurious radiation directly radiated from launching means 18 or from the termination of the antenna. Then, by systematically changing the value of $Re(\Delta^2)$ over the surface as a function of time, the direction of radiation can be scanned or adjusted.

The terminating surface means 16 preferably has a surface impedance which is zero or at least very low, which has the effect of causing radiation of the guided wave, to the extent that it has not already been radiated or absorbed as it passes over the controllable surface impedance means 14. Thus, the illustrated terminating surface means 16 comprises a plate made of a highly conductive material and of a sufficient thickness to give a very small surface impedance magnitude.

The illustrated wave guide sections 30 are made of conductive material and are rectangular in shape and are thus particularly well adapted for use with waves of the $TE_{10}$ wave guide mode. In this case, the longitudinal or $E_\rho$ component of the electric field of a TM wave guided along the surface 14 is coupled into the wave guide aperture 32. It will be understood that the wave guide sections may be square in cross section, or nearly so, so as to be well adapted for handling $TE_{10}$ or $TE_{01}$ modes which are coupled with $E_\rho$ or $H_\rho$ for a TM or TE guided wave, respectively, traveling along the surface 14. More complex modes can also be handled.

FIGS. 2 and 3 illustrate the fact that the controllable surface means 14 may utilize wave guide elements of other suitable configurations, such as the coaxial configuration of FIGS. 2 and 3.

Thus, FIG. 2 illustrates a modified TEM wave guide section 40 comprising coaxial inner and outer conductive cylinders 42 and 44. The wave guide section 40 is adapted to propagate TEM waves, in which both the electric and magnetic fields are transverse to the direction of propagation. As before, the reflection amplifier 34 is connected to the wave guide section 40. In this case, an electric dipole probe 46 is connected to the inner conductive cylinder 42 to assist in coupling energy to and from the wave guide section 40 through the longitudinal electric field $E_\rho$ of the TM wave traveling above the surface 14. It will be seen that the probe 46 is in the form of a linear conductor which is parallel to the plane of the surface means 14.

FIG. 3 illustrates a modified construction which is the same as shown in FIG. 2, except that the linear probe 46 is replaced by a loop-type probe 48, connected between the inner and outer conductive cylinders 42 and 44. The probe 48 is positioned above the plane of the surface means 14 so as to couple with the longitudinal component of the magnetic field $H_\rho$ corresponding to a TE guided wave. Thus, the construction of FIG. 3 is particularly well adapted for use with TE guided waves.

Note that by rotating the configurations of FIGS. 2 and 3 through an angle of 90° about a central vertical axis, e.g. the axis of the wave guide or the coaxial lines in FIGS. 2 and 3, these devices will be caused to couple with the dual type of guided wave. For example, by rotating the device of FIG. 2 through an angle 90° about the axis of the center conductor 42, the dipole 46 will be caused to couple with the transverse $E_\phi$ component of a TE guided wave. Similarly, rotation of the device of FIG. 3 through 90° about the central axis will cause the loop 48 to couple with the transverse $H_\phi$ component of the TM guided wave.

It will be understood that the reflection amplifiers 34 may employ any known or suitable active elements to produce the desired amplification. For example, each reflection amplifier 34 may employ one or more IM- PATT, tunnel, Gunn, or Schottky diodes, or transfer electron devices or microwave transistors.

Figure 4:
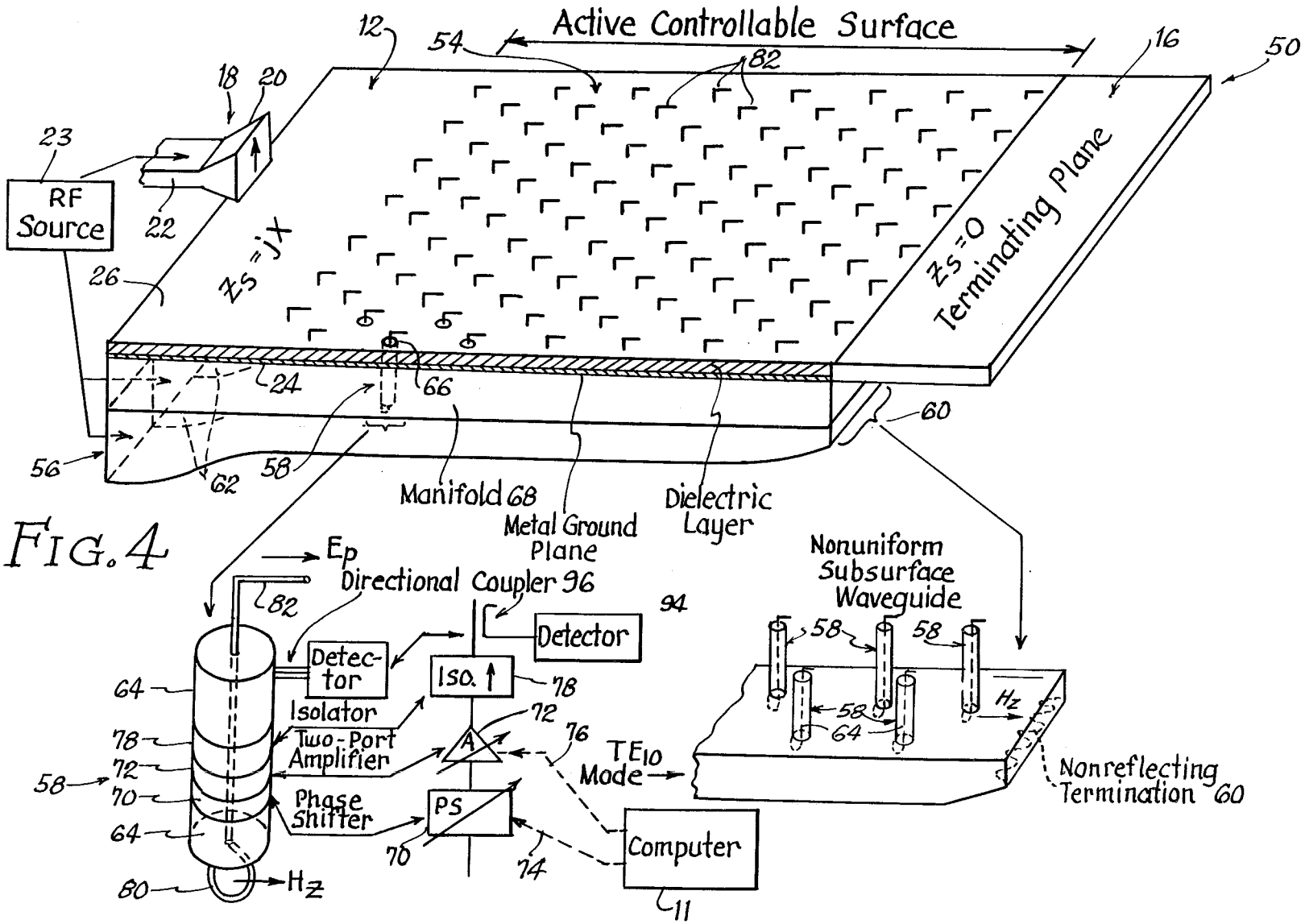
FIG. 4 is a diagrammatic view similar to FIG. 1, but showing a modified antenna to be described as a second embodiment of the present invention.

FIG. 4 illustrates a second embodiment of the present invention comprising a modified electronically controllable guided wave antenna 50. As before, the directional characteristics of the antenna 50 are subject to control by signals from the computer 11 or any other suitable control means.

In the antenna 50, the initial surface means 12 and the terminating surface means 16 may be substantially the same as described in connection with the antenna 10 of FIG. 1. However, the antenna 50 comprises modified electronically controllable surface means 54, replacing the surface means 14 of FIG. 1.

The antenna 50 may employ the same launching means 18, as described previously, for launching a surface wave along the initial surface means 12 so that the wave will pass along the electronically controllable surface means 54 and the terminating surface means 16. As before, the launching means 18 may comprise a wave guide horn 20 connected to the wave guide 22 which receives radio frequency energy from the radio frequency source 23. The surface wave launched by the launching means 18 may be of either the TM or TE mode.

In the antenna 50 of FIG. 4, additional radio frequency wave energy is fed from the radio frequency source 23 into a subsurface wave guide structure 56 located below the surface means 12 and 54. Wave energy is supplied from the subsurface wave guide structure 56 to the controllable surface 54 of the antenna by an array of coupling elements 58. Preferably, the coupling elements 58 are electronically controllable, as to both gain and phase shift, so that the amplitude and phase of the wave energy supplied to the controllable surface 54 by each coupling element 58 can be electronically varied.

As shown in FIG. 4, the subsurface wave guide structure 56 is preferably provided with a non-reflecting termination 60 which absorbs any remaining energy which has not been fed from the wave guide structure 56 into the coupling elements 58.

The subsurface guiding structure 56 can take a variety of different forms, such as rectangular, circular, internally modulated or serrated, dielectric filled, coaxial, or septum divided, for example. As illustrated, the subsurface guiding structure 56 is in the form of a generally rectangular conductive guide or duct and is provided with conductive partitions 62 such that, normally, only the lowest order $TE_{10}$ mode propagates.

The coupling elements 58 may also assume a wide variety of forms. As illustrated in FIG. 4, each coupling element 58 may comprise a wave guide section or duct 64 made of conductive material and extending from the subsurface guiding structure 56 through an opening 66 in the surface means 54. As shown, the surface means 54 comprise an extension of the initial surface means 12 utilizing the conductive metal slab or ground plane 24 surmounted by the lossless or low-loss dielectric slab layer 26. The coupling elements 58 extend upwardly from the subsurface guide 56 through a manifold zone 68 located between the subsurface guide 56 and the ground plane 24, and then through the openings 66 so that the wave guide elements 64 can deliver wave energy to the guided wave propagating above and within the dielectric layer 26.

It is preferred to incorporate electronically controllable amplification and phase shifting into the coupling elements 58. As shown in FIG. 4, an electronically controllable phase shifter 70 and an electronically controllable amplifier 72 are incorporated into each wave guide section. Control lines 74 and 76 are provided between the computer 11 and the electronically controllable phase shifter 70 and the amplifier 72 to supply control signals thereto. An isolator 78 may also be incorporated into the wave guide section 64 so that the amplifier 72 and the phase shifter 70 will not be affected by conditions in the space above the antenna surface 54. However, the amplifier 72 may provide the desired isolation, as described in connection with FIG. 9.

At the input end of the coupling element 58, a probe 80 is preferably provided to pick up energy from the subsurface wave guide 56. At the output end of the coupling element 58, an output element or probe 82 is connected to the output of the wave guide section 64 so as to deliver wave energy to the traveling wave about the surface 54. It will be seen that the output elements 82 of all of the coupling elements 58 are disposed in an area above the controllable antenna surface 54.

The input probe or pickup element 80 may assume a variety of forms for coupling to TE or TM modes, or both, using a convenient E or H field component of any selected mode or modes in the subsurface wave guide 56.

As shown in FIG. 4, the input probe 80 is in the form of a pickup loop adapted to couple to a magnetic field component in the subsurface wave guide 56, such as the longitudinal component $H_z$ of the magnetic field of the $TE_{10}$ mode in the wave guide. Coupling to this magnetic component can readily be achieved by offsetting the probes from the center of each channel of the subsurface guide 56, or by coupling into the narrow wall of the guide channel.

The output probe 82 for each coupling element 58 may also assume a variety of forms. As shown, the output element 82 is in the form of an electric dipole extending generally in the direction in which the guided wave is propagated along the antenna surface 54. This dipole 82 couples to the electric component $E_\rho$ of a TM wave. The nature of the probes 80 and 82 may be varied in accordance with the modes of the waves which are propagated through the subsurface wave guide 56 and along the antenna surface 54.

In the usual case, the coupling elements 58 of FIG. 4 are spaced apart by a distance which is less than one-half free space wavelength. With this arrangement, the radiation pattern can readily be calculated by using a leaky wave theoretical approach. Furthermore, if the spacing is substantially less than one free space wavelength, the production of grating lobes in the radiation pattern is avoided. This is also true of the antenna of FIG. 1.

The antenna 50 of FIG. 4 operates somewhat in the manner of a leaky wave guide in which energy is coupled out of the guide into the wave traveling above the antenna surface 54. The energy coupled through each of the coupling elements 58 is regulated as to both phase and amplitude by the electronically controllable phase shifter 70 and the amplifier 72. By varying the phase and amplitude of the energy transmitted by the coupling elements in a systematic manner, it is possible to cause the radiated beam from the antenna 50 to swing over a wide sector from end fire to nearly broadside. This can be accomplished while maintaining the frequency of the wave energy constant, as contrasted to frequency sweeping which is conventionally used to cause beam scanning of leaky wave antennas.

The subsurface wave guide structure 56 may be nonuniform in construction and shape so as to distribute the properly phased wave energy to each coupling element 58. In each case, the electronically controllable phase shifter 70 may be employed to vary the phase. In this way, virtually any desired leaky wave pattern can be achieved on the antenna surface 54. The electronically controllable phase shifters 70 and amplifiers 72 may then be employed to cause the beam to scan across the desired sector. Appropriately coordinated control signals are supplied to the phase shifters 70 and amplifiers 72 by the computer 11.

The control signals supplied to the amplifiers 72 by the computer 11 are appropriately coordinated with the control signals supplied to the phase shifters 70.

The antenna 50 of FIG. 4 has the advantage that the effects of mutual coupling between the coupling elements 58 are avoided because of the provision of the isolators 78, which transmit energy in one direction only, from the coupling elements 58 to the space above the antenna surface 54, but not in the reverse direction.

In the antenna 10 of FIG. 1, utilizing the wave guide elements 30 with reflection amplifiers 34, there is mutual coupling between all of the individual elements. Such mutual coupling can affect the operation of the reflection amplifiers because small changes in the adjacent elements cause changes in the reflection coefficients presented to the waves emerging from the reflection amplifiers. When unwanted reflection occurs in one of the wave guide elements 30, the wave initially amplified by the reflection amplifier is partially reflected back to the reflection amplifier and is again amplified. This bouncing process is repeated, with the result that, under certain conditions, the reflection amplifier may break into oscillation. To avoid stability problems, the wave guide sections 30 and the reflection amplifiers 34 of FIG. 1 must be properly adjusted.

In the antenna 50 of FIG. 4, the coupling elements 58 are one-way devices so that instability problems are avoided. The amplifiers 72 operate in a stable manner without appreciable regeneration, since each amplifier is isolated from its neighbors by the nonreciprocal isolators 78. All of the amplifiers 72, phase shifters 70, and isolators 78 act in concert to establish the desired pattern of the surface currents on the antenna structure, or, equivalently, the surface impedance. Surface impedances with negative real components are readily achievable since radio frequency energy can readily be made to emerge from the antenna surface, while the phase angle of the surface impedance can readily be controlled by varying the phase shifters 70.

However, the antenna structure 50 of FIG. 4 is nonreciprocal, since the flow of energy is constrained to only one direction in each of the elements 58. For this reason, the properties of the antenna differ for transmission and reception. Thus, the transmitting and receiving patterns are different. For applications such as radar, in which the same antenna is used for both transmission and reception, the reciprocal antenna of FIG. 1 is usually preferable to the nonreciprocal antenna of FIG. 4.

In the antenna of FIG. 4, it is possible to omit the launching device 18, in which case all of the wave energy will be supplied to the antenna surface 54 by the array of coupling elements 58. Of course, the elimination of the launching device 18 will affect the radiation pattern. However, the desired radiation pattern can normally be achieved by readjusting the phase shifters 70 and the amplifiers 72.

One important advantage of the electronically controllable antennas of the present invention resides in the fact that individual antenna elements can be modulated to assist in the process of analyzing and determining the directional characteristics of the antennas.

As shown in FIG. 1, a modulator 90 may be employed in conjunction with the computer 11 to modulate any or all of the control signals supplied to the reflection amplifiers 34. The modulator 90 may be separate from the computer 11 or incorporated into the computer. The arrangement is preferably such that each control signal to each reflection amplifier 34 can be modulated individually.

In the usual case, the signal which controls the gain of the reflection amplifier 34 is modulated so that modulation is impressed upon the amplitude of the reflected wave energy from the reflection amplifier. However, the signal controlling the phase shift of the amplifier 34 can also be modulated.

The surface fields on the antenna 10 can be measured by operating the modulator 90 so as to modulate each reflection amplifier 34 in turn. Such modulation varies the component of the antenna field which is attributable to the corresponding antenna element 28. The field which is scattered from each modulated element 28 is coherently detected by a detector 92 connected to the wave guide 22, to which the radio frequency source 23 is also connected. In this way, the amplitude and phase of the surface field at the modulated element can be determined.

By modulating each antenna element 28 in turn, it is possible to determine the overall surface field, which can then be used to compute the corresponding radiation pattern. Thus, the antenna is capable of being self-diagnostic in that the antenna elements can be used to measure the surface fields or equivalently the surface currents on the antenna so that its radiation pattern can be determined. There is no need to utilize auxiliary probes on the antenna to measure the surface field.

Since the antenna 50 of FIG. 4 is nonreciprocal, this field measurement technique will not work. However, since the surface 56 is comprised of an array of coupling elements or probes 58, each probe can be used to sample the field at its position to accomplish the same purpose.

Instead of utilizing the modulators 90 and the detector 92, the antenna 50 of FIG. 4 is provided with an array of detectors 94. Each detector 94 may be incorporated into one of the coupling elements 58, above the isolator 78. Thus, each detector 94 is coupled to the coupling element 58 between the isolator 78 and the antenna surface 54. Each detector 94 can then be used to measure the field along the surface 54 at each element 58.

Such detection can be accomplished by using a directional coupler 96 which senses only the energy traveling downward in each coupling element 58. Each directional coupler 96 is employed between each coupling element 58 and the corresponding detector 94. By making individual measurements at each of the detectors 94, the amplitude of the field over the entire antenna surface 54 can be measured.

In the antennas 10 and 50 of FIGS. 1 and 4, a surface or traveling wave is launched with high efficiency by the wave guide horn 20 over the initial antenna surface 12. The launching efficiency is due in large part to the fact that the surface 12 has a surface impedance which is purely imaginary or inductive reactance ($Z_s=jX$), or nearly so. The surface wave which travels along the initial surface 12 may be characterized as a "slow" or "surface" wave.

Generally speaking, guided waves are characterized as being either "slow" or "fast", depending upon whether the phase velocity of the wave is less than or greater than the speed of light. A slow guided wave is characterized by being nonradiating in that the wave is constrained to propagate close to the surface and to be attenuated by any surface losses and the spreading of energy. On the other hand, a fast wave is also being radiated, in addition to being propagated along the surface. If the surface impedance changes, either gradually or abruptly, radiation can also occur from a slow wave.

The determining factor as to whether a wave is slow or fast resides in the phase angle of the complex surface impedance. When the surface impedance is purely imaginary or inductive reactance ($Z_s=jX$), as in the case of the initial antenna surface 12, the guided wave is a surface wave which is confined near the surface and does not radiate or attenuate except for spreading of the wave as it propagates from the source. The magnitude of X determines the wave energy profile above the surface. For large positive values of X, the wave clings tightly to the surface, but if X is positive and small, the wave is very loosely bound, and the energy distribution extends considerably higher above the surface.

The phase angle of the surface impedance along the intermediate controllable surface 14 is determined by the gain and phase shift of the reflection amplifiers 34. By increasing the gain of the reflection amplifiers, the surface impedance can be given a negative resistance component. When the surface impedance is nearly a purely negative resistance, the wave is fast and energy is radiated from the surface.

The angle of radiation is primarily determined by the magnitude of the component of the surface impedance located along the negative real axis. For small magnitudes, the radiation is near the plane of the surface. The radiation can be made to scan vertically by increasing the magnitude of the negative real component of the surface impedance.

To express this point mathematically, the angle of radiation is primarily determined by the relation, $$\mathrm{Re}(\Delta^2)=\text{constant}$$

where $\Delta=Z_s/\eta_o$ is the surface impedance normalized by the intrinsic impedance of free space $\eta_o$ ($=120\pi$), when $\Delta$ is located in the vicinity of the negative real axis. For small magnitudes of $\mathrm{Re}(\Delta^2)$, the radiation is near the plane of the surface. The radiation can be made to scan vertically by increasing $\mathrm{Re}(\Delta^2)$.

The antennas 10 and 50 of FIGS. 1 and 4 involve the technique of launching the surface wave over a purely highly inductive surface 12 with a moderately large reactance X, which may be of the order of $60\pi$ ohms to achieve a high efficiency of launching or converting the source energy into a nonradiating surface wave.

As the guided surface wave propagates along the surface 14 of FIG. 1, or the surface 54 of FIG. 4, the surface can be made to amplify the wave so that it becomes a growing guided wave without substantial radiation. The purpose of this amplification without radiation is to enhance the guided wave so that when it is radiated its pattern will greatly overshadow the spurious radiation radiated directly from the source 18, or from regions of transistion in the surface impedance profile along the antenna such as the end of the antenna. Such spurious radiation is unavoidable and is the primary cause of objectionable side lobes. However, their effect can be made negligible using this technique of amplifying the guided wave with or without simultaneous radiation.

When sufficient amplification of the surface wave has been achieved, the surface impedance can be gradually changed to an essentially negative real quantity causing the initially launched and amplified energy to be radiated from the surface at some angle with respect to the surface 14 or 54. Here both amplification and radiation will occur. If the amount of radiation exceeds the amplification, the guided wave will experience a net attenuation. At some further point near the end of the non-uniform controllable surface 14 or 54, the surface impedance magnitude is gradually reduced to nearly zero, and nearly all of the remaining energy in the guided wave is radiated.

The provision of this region of gradual termination has the additional advantage of reducing the wave reflection which would otherwise be produced by an abrupt transition. In the usual case, this transitional region may be of the order of one-half to one free space wavelength long. Any remaining energy in the guided wave is radiated when the wave reaches the terminating surface 16 of zero impedance or nearly so.

Alternatively, if the antenna is to radiate end fire, the traveling wave is kept slow all along the surfaces 14 and 54, while simultaneous amplification is taking place. In this case, radiation takes place almost entirely in the end fire direction at the termination plane 16.

It will thus be evident that it is highly advantageous to provide a guided wave antenna having a surface which can be made non-uniform so that the waves traveling along the antenna can be controlled in a progressive manner. It is a matter of further advantage to provide an antenna in which the non-uniform surface impedance can be varied electronically by supplying control signals to the elements of the antenna. In this way, the directional characteristics of the antenna can be scanned electronically to suit a wide variety of applications.

It will be understood that the launching means 18 may include various elements for launching a traveling wave along the antenna. While a wave guide horn 20 is shown for this purpose in FIG. 1, such horn may be replaced with various other elements, such as a dipole, yagi, or any other suitable antenna element.

In the antenna of FIG. 4, the launching means 18 is an optional feature and may be eliminated entirely if desired. In that case, the traveling wave energy is supplied to the antenna by the subsurface wave guide means 56 and the coupling elements 58.

The antennas of FIGS. 1–4 have the advantage that they may be used to operate in either the TM (transverse magnetic) or TE (transverse electric) modes. Moreover, the antennas can be used to operate in both TM and TE modes on a time-shared basis.

The antennas can be adapted to operate in the two different modes by changing the adjustment of the variable surface impedance means to achieve the desired antenna characteristics favorable for control of a TM wave, or the desirable surface admittance for a TE wave. By pulsing the control signals supplied to the electronically variable impedance elements, the antennas can be switched between the conditions most favorable for operation in the TM and TE modes. Thus, the antenna can be used during part of each pulse cycle in the TM mode and during the remainder of the pulse cycle in the TE mode.

It will be understood that the use of the sampling detectors 94 and directional couplers 96 is not restricted to the particular antenna of FIG. 4, but is also applicable to the antenna constructions of FIGS. 1–3. Thus, the sampling detectors 94 and the directional couplers 96 may be connected to the wave guide sections 30 of FIG. 1, or to the wave guide sections 40 of FIGS. 2 and 3. By using the sampling detectors 94, the various components of the field being sampled by the probes 32, 46 and 48 can be measured so as to give the amplitude of the field distribution over the antenna surface. The directional couplers 96 make it possible to sample only the energy propagating downward in the wave guide sections 30 and 40.

In the antenna of FIG. 4, the direction of some or all of the coupling elements 58 can be reversed so that the antenna can be used more advantageously for reception as well as for transmission. Thus, some of the coupling elements 58 can be used for transmission while others are reversed so that they can be used for reception. The coupling elements 58 which are used for transmission are arranged to transmit energy from the subsurface wave guide section 56 to the space immediately above the antenna surface 54.

The reversed coupling elements transmit the energy in the opposite direction from the space immediately above the antenna surface 54 to a subsurface wave guide system which may be either separate from or combined with the subsurface wave guide system which is used for transmission. By using some of the coupling elements 58 for transmission and others for reception, it is possible to use the antenna simultaneously for both transmission and reception of different frequencies, with either the same or different directional characteristics. The directional characteristics for both transmission and reception can be varied or scanned electronically by supplying control pulses or signals to the variable phase shifters 70 and amplifiers 72.

If desired, some or all of the coupling elements 58 can be arranged so as to be reversible electronically. This can be done by arranging the amplifiers 72 and isolators 78 with electronically controllable channels extending in both directions. The transmission channel and the reception channel of each coupling element 58 can then be activated alternatively by supplying appropriate control pulses or signals. In this way, the coupling elements 58 can be used for both transmission and reception on a time-shared basis. Various other means may be employed for the reciprocal use of the antenna for transmission and reception.

FIG. 5 illustrates a modified electronically controllable surface impedance element 28*a*, which is similar in most respects to the impedance element 28 of FIG. 1. Variable impedance elements like the impedance element 28*a* of FIG. 5 may be employed instead of the impedance elements 28 in the electronically controllable traveling or guided wave antenna 10 of FIG. 1. Except as otherwise described, the modified variable impedance element 28*a* may be the same as the previously described impedance element 28. In FIG. 5, the same reference characters have been employed as in FIG. 1 to identify corresponding components.

As before, the electronically controllable surface impedance element 28*a* of FIG. 5 may comprise a wave guide section or element 30 which leads from the surface means 14 of FIG. 1. The wave guide section 30 has an open end 32 communicating with the surface means 14. The illustrated wave guide section 30 is hollow and rectangular in cross section and is in the form of a rectangular pipe or duct made of conductive material, such as metal, for example.

As in the case of FIG. 1, the guided radio frequency wave travels across the open end or aperture 32 of each wave guide section 30. Some of the guided wave energy is coupled into the wave guide section 30.

It will be recalled that in the construction of FIG. 1, a variable reflection amplifier 34 is provided to reflect the wave energy back through the wave guide section 30 to the aperture 32, where the reflected wave energy is recombined with the guided wave above the surface means 14. The reflection amplifier 34 comprises means for separately controlling the phase and the amplitude of the reflected wave energy.

In the variable impedance element 28*a* of FIG. 5, the functions of amplitude control and phase control are separated by utilizing a reflection amplifier which is split into an amplifier section 34*a* and a phase shifter section 34*b*. The phase shifter section 34*b* is disposed along the wave guide section 30 between the aperture 32 and the amplifier section 34*a*.

The electronically controllable phase shifter may be of any known or suitable type. A variety of electronically controllable phase shifters are available, such as diode types. The phase shifter 34*b* should be reciprocal, because the wave passes through the phase shifter twice. Hence, the total phase change introduced by the phase shifter 34*b* is twice its one-way phase shift.

The illustrated phase shifter 34*b* is of the known Reggia-Spencer ferrite type, having the advantage that it provides continuous phase control. Moreover, the differential phase change can be made linear with the control current I.

Thus, the phase shifter 36*b* of FIG. 5 comprises a ferrite body or slug 102 which is disposed within the wave guide section 30. As shown, the ferrite body 102 extends along the axis of the wave guide section 30 and is elongated and generally rectangular in cross section. At both ends, the illustrated ferrite body 102 has tapered end portions 104 to minimize reflections of the wave energy by the ferrite body.

To provide for electronic control, the illustrated phase shifter 34*b* comprises a coil or solenoid 106 adapted to magnetize the ferrite body 102. Thus, the coil 106 is disposed around the ferrite body 102. The illustrated coil 106 is also around the outside of the portion of the wave guide section 30 in which the ferrite body 102 is located. The phase control current I is caused to flow through the coil 106, under the control of the computer 11. The ends of the coil 106 are brought out to conductive leads 108 and 110, to which the phase control current I is supplied.

To improve the rapidity of the phase control, longitudinal slots 112 are preferably formed in the conductive broad walls of the wave guide section 30 within the coil 106 and near its ends. These slots 112 prevent the closed walls of the wave guide section 30 from acting as a shorted one-turn secondary to the coil 106, which would slow down the rise and the fall of the current in the coil 106 and thus would tend to produce an undesirably long response time. The longitudinal slots 112 reduce the response time of the coil 106 by breaking up the eddy current paths in the conductive walls of the wave guide section 30. To increase the impedance of the eddy current paths, the walls of the wave guide section 30 are made relatively thin, at least in the region within the coil 106. By the provision of the longitudinal slots 112 and the thin walled wave guide, the response time can be reduced to a fraction of a millisecond. Thus, the phase shifter **34*b* is able to respond quickly to rapid changes in the control current I. Accordingly, it is readily possible to make fast changes in the radiated beam from the electronically controlled antenna 10. The computer 11 provides the proper control current I for the phase shifter 34*b* of each variable impedance element 28*a***.

Instead of the illustrated phase shifter, it is possible to use any of many different types of phase shifters which are quite common in all types of microwave work.

As shown in FIG. 5, the second cross-sectional dimension b of the wave guide section 30 is approximately one-half the first dimension a. For this arrangement, the wave guide section 30 propagates the $TE_{10}$ mode. However, the dimensions b and a can be made equal, in which case the wave guide will propagate either the $TE_{10}$ mode or the $TE_{01}$ mode. The $TE_{10}$ mode is coupled to $E_\rho$ of a TM guided wave, while the $TE_{01}$ mode is coupled to $E_\phi$ of a TE guided wave.

A wide variety of designs of reflection amplifiers are known and available for use in either wave guides or coaxial lines. Many such designs are described in several papers published in the IEEE Transactions on Microwave Theory and Techniques, MTT-18(11), November 1970, Special Issue on "Microwave Circuit Aspects of Avalanche-Diode and Transferred Electron Devices." The illustrated amplifier **34*a* of FIG. 5 is an example of such a reflection amplifier. As shown in FIG. 5, the amplifier 34*a* is in the form of a bidirectional amplifier, with its output port shorted. The bidirectional amplifier utilizes a negative resistance diode 114, which may be of any known or suitable type, such as Gunn, IMPATT, or transferred electron devices (TED). Other negative resistance devices may be employed. As shown, the negative resistance diode 114 is connected between the opposite sides of the wave guide section 30, along the b dimension. The diode 114 has leads 116 and 118 which extend generally parallel to the b dimension. The lead 116 is conductively connected to one side of the wave guide section 30, while the lead 118 is brought out of the other side of the wave guide section through a small opening 120. As to radio frequency energy, the lead 118 is capacitively coupled to the waveguide wall. The lead 118 is supplied with a control voltage $V_D$ which is supplied by the computer 11 and is employed to vary the gain (or attenuation) afforded by the amplifier 34*a***.

For all negative resistance devices, and particularly for all negative resistance diodes, which usually have a low impedance, it is generally necessary to provide appropriate impedance transformers within the wave guide section 30, to match the wave guide to the low impedance diode. This matching structure or network can have a variety of forms, such as irises, dielectric loading or the stepped structure 122 shown in FIG. 5. It will be seen that the stepped impedance transformer structure 122 comprises a conductive block or member 124 which is disposed within the wave guide section 30 and is stepped in the b direction. Thus, the conductive member 124 has first, second and third steps **124*a*, b and c. The second step 124*b* is higher than the first and third steps 124*a* and 124*c*. In this case, the negative resistance diode 114 is connected to the second step 124*b*. The first and third steps 124*a* and c provide impedance transistions to the low impedance diode 114**.

The amplifier **34*a* is bidirectional in the sense that it amplifies waves traveling in both directions in the wave guide section 30, both up and down, as shown in FIG. 5. However, a downwardly traveling wave is reflected by a short circuit 126 at the lower end of the wave guide section 30. The short circuit may simply take the form of a closed conductive wall at the lower end of the guide 30**.

In the usual operation of the variable impedance elements **28*a* of FIG. 5, the wave guided along the variable surface impedance means 14 of the antenna 10 of FIG. 1 is coupled into the open end or aperture 32 of each wave guide section 30. The coupled wave is propagated downwardly through the phase shifter 34*b*, and then through the negative resistance bidirectional amplifier 34*a*, with the result that the wave is amplified. The wave is propagated downwardly through the remainder of the wave guide section 30 and then is reflected upwardly by the short circuit 126. The wave then passes upwardly through the bidirectional amplifier 34*a* and is amplified again, whereupon the wave passes upwardly through the phase shifter 34*b* and is phase shifted again. The wave emerges at the open end 32 of the wave guide section and is combined with the wave energy guided along the variable surface impedance means 14. Thus, viewed at its input, the shorted two-port bidirectional amplifier 34*a* is really a one-port reflection amplifier. The gain of this reflection amplifier 34*a*** is controlled by the diode bias voltage $V_D$, which originates in the computer.

It should be noted that the adjustment of the diode bias voltage $V_D$ also generally affects the phase shift produced by the reflection amplifier **34*a* as well as the gain produced by the amplifier. This change in the phase shift must be properly compensated for by the control of the phase shifter 34*b***.

For testing the electronically controllable antenna 10 and measuring its radiation or propagation pattern, it is advantageous to provide for modulation of each of the variable impedance elements **28*a*. Such modulation will change the field at the aperture 32 of the wave guide section 30. Such modulation can be accomplished by modulating either the amplifier 34*a* or the phase shifter 34*b*. The amplifier 34*a* can be modulated by modulating the amplitude of the diode bias or control signal $V_D$ with a square wave, or a modulating signal of some other desired wave form. The modulation of the amplifier control signal $V_D$ primarily varies the gain of the amplifier 34*a***.

The phase shifter **34*b* can be modulated by modulating the control current I with a sawtooth wave, and thereby linearly phase modulating the emerging signal from the aperture 32 of the wave guide section 30**. Modulating signals of other waveforms may be employed, if desired.

With either type of modulation, the emerging wave propagates along the surface impedance means 14, and then along the launching surface 12 to the wave guide horn 20 and the detector 92. As previously indicated, the detector 92 is preferably of the coherent type, utilizing the received signal, and also a signal from the radio frequency source 23. The modulated and detected wave is proportional to $E_\rho^2$ in both amplitude and phase, and so each wave guide element 28a can be modulated in turn to determine the amplitude and phase of the $E_{92}$ -field distribution over the entire variable impedance surface 14. This information can then be used to compute the radiation pattern of the antenna 10.

The wave guide section 30 of FIG. 5 may be provided with any known or suitable means for tuning the wave guide, as needed. Thus, for example, FIG. 5 illustrates a tuning screw 128 which is mounted in a threaded aperture formed in one wall of the wave guide section 30, between the negative resistance diode 114 and the short circuit 126. One or more tuning screws of this kind may be appropriately located and adjusted to provide the desired tuning of the wave guide section 30.

FIG. 6 illustrates a modified coaxial wave guide section 40a which is similar in most respects to the wave guide section 40 of FIG. 2. The same reference characters have been used in FIG. 6 as in FIG. 2, where applicable. Except as otherwise described or illustrated, the wave guide section 40a may be the same as the wave guide section 40.

As before, the wave guide section 40a is of the TEM type, comprising coaxial inner and outer conductive cylinders 42 and 44. The wave guide section 40a is adapted to propagate TEM waves, in which both the electric and magnetic fields are transverse to the direction of propagation. An electric dipole probe 46 is connected to the inner conductive cylinder 42 at its upper end to assist in coupling energy to and from the waveguide section 40a through the longitudinal electric field $E_{92}$ of the TM wave guided along the surface impedance means 14 in the antenna 10 of FIG. 1. The probe 46 is in the form of a linear conductor which is parallel to the surface means 14. It will be understood that a multiplicity of wave guide sections like the section 40a of FIG. 6 may be employed instead of the wave guide sections 30 of FIGS. 1 and 5. The wave guide sections 40a can also be employed interchangeably with the wave guide sections 40 of FIG. 2.

It will be recalled that the wave guide section 40 of FIG. 2 employs the reflection amplifier 34 which is adapted to vary both the amplitude and the phase of the reflected waves. In the construction 40a of FIG. 6, this reflection amplifier 34 is shown as being split into a variable gain reflection amplifier 134A and a reciprocal phase shifter 134b.

In most respects, the phase shifter 134b is closely similar to the phase shifter 34b of FIG. 5. Thus, the phase shifter 134b of FIG. 6 is of the Reggia-Spencer ferrite type, comprising a ferrite body 102a which is mounted in the wave guide section 40a between the inner and outer conductive cylinders 42 and 44. As shown, the ferrite body 102a is in the form of a ferrite sleeve, mounted around the inner conductor 42. The ferrite body 102a preferably has tapered ends 104a to minimize reflection of the waves within the guide 40a. In all other respects, the description of the ferrite body 102 is applicable to the ferrite body 102a.

A coil or solenoid 106a is provided to magnetize the ferrite body 102a so as to change the phase shift of the waves traveling within the guide 40a. As before, the coil 106a is wrapped around the outside of the outer cylindrical conductor 44. The coil 106a has end leads 108a and 110a for supplying the control current I to the coil. The outer cylindrical conductor 44 is preferably formed with a number of longitudinal slots 112A to prevent the outer conductor 44 from acting as a short-circuited secondary turn within the coil 106a. The outer cylindrical conductor 44 is also made with a thin wall to minimize eddy currents. The provision of the slots 112a and the thin wall makes it possible for the coil 106a to maintain a fast response to rapid changes in the control current I. In other respects, the description of the elements 106, 108, 110 and 112 is applicable to the corresponding elements 106a, 108a, 110a and 112a.

FIG. 6, the reflection amplifier 134a may utilize the same negative resistance diode 114 as described in connection with FIG. 5. In the arrangement of FIG. 6, the negative resistance diode 114 is connected between the lower end of the inner cylindrical conductor 42 and a conductive short-circuiting end wall 126a which closes the lower end of the outer conductor 44.

A control lead 118a is brought out from the inner conductor 42 through a small opening 120a in the outer conductor 44. In some cases, a radio frequency choke coil 118b may be connected in series with the lead 118a, but in some cases the inductance of the lead 118a will be sufficient to obviate any need for the radio frequency choke coil 118b. The lead 118a is connected to the control lead 36a, as described in connection with FIGS. 1 and 2. The diode bias or control voltage $V_D$ is applied to the lead 36a. The control voltage $V_D$ is under the control of the computer 11. The gain of the amplifier 134a can be changed by varying the control voltage $V_D$.

In the construction of FIG. 6, the amplifier 134a is tuned by varying a shorted tuning stub 128a having an inner conductor 128b, an outer conductor 128c, and a short-circuiting member 128d which is slidable between the conductors 128b and c. The outer conductor 128c of the tuning stub 128a is connected to the outer conductor 44 of the wave guide 40a. The inner conductor 128b of the tuning stub 128a is connected to the inner conductor 42 at its lower end through a blocking capacitor 128e which prevents the tuning stub from short circuiting the control voltage $V_D$.

The coaxial wave guide 40a of FIG. 6 preferably includes impedance matching means for matching the relatively high impedance of the coaxial wave guide to the relatively low impedance of the negative resistance diode 114. As shown, the wave guide 40a of FIG. 6 utilizes impedance matching means in the form of a dielectric bead impedance transformer 122a, disposed just above the lower end of the inner conductor 42, to which the negative resistance diode 114 is connected. However, in the alternative, the wave guide 40a of FIG. 6 may employ an impedance transformer of the stepped type, analogous to the stepped impedance transformer 122 of FIG. 5. Such a stepped impedance transformer involves steps in the ratio of the diameters of the inner and outer conductors 42 and 44. Those skilled in the art will be familiar with both dielectric impedance transformers and stepped impedance transformers.

The reflection amplifier 134a of FIG. 6 is similar to the construction described by B. S. Perlman, C. L. Upadhyayula and R. E. Marx in the paper entitled, "Wide-band reflection-type transferred electron amplifiers, " IEEE Transactions on Microwave Theory and Techniques, MTT-18(11), November 1970, Page 911.

In the wave guide section 40a of FIG. 6, the control of the phase shifter control current I and the amplifier gain control signal $V_D$ is by the computer, the same as described in connection with FIGS. 1, 2 and 5. The modulation of the phase shifter control current I and the amplifier gain control signal $V_D$ may be the same as described in connection with FIG. 5.

As already indicated, changing the diode bias or control signal $V_D$ affects the phase shift as well as the gain produced by the reflection amplifier, in the constructions of FIGS. 5 and 6. This behavior is explained in the paper by P. Brook, L. D. Clough and K. G. Hambleton entitled "Microwave phase shifting with gain using IMPATT diodes," Electronics Lett., 8 (19), Sept. 21, 1972.

If desired, the phase shifters **34*b* and 134*b* of FIGS. 5 and 6 can be controlled so as to compensate for the changes in the phase shift produced by the variations in the control signals to the amplifiers 34*a* and 134*a***.

In certain cases, the phase shift changes produced by the amplifiers **34*a* and 134*a* may be employed without compensation, so that it may be possible to dispense with the separate phase shifters 34*b* and 134*b***.

FIG. 7 illustrates a modified wave guide construction **40*b* which is the same as the wave guide 40*a* shown in FIG. 6, except that the linear probe 46 is replaced by the loop-type probe 48, connected in series with a blocking capacitor, between the inner and outer conductive cylinders 42 and 46. The loop-type probe 48 is otherwise the same as described in connection with FIG. 3. The probe 48 is positioned above the surface means 14 in the antenna 10 of FIG. 1, so as to couple with the longitudinal component of the magnetic field $H_{92}$, corresponding to a TE traveling wave. The description relating to FIG. 3 is also applicable to FIG. 7**.

Figure 8:
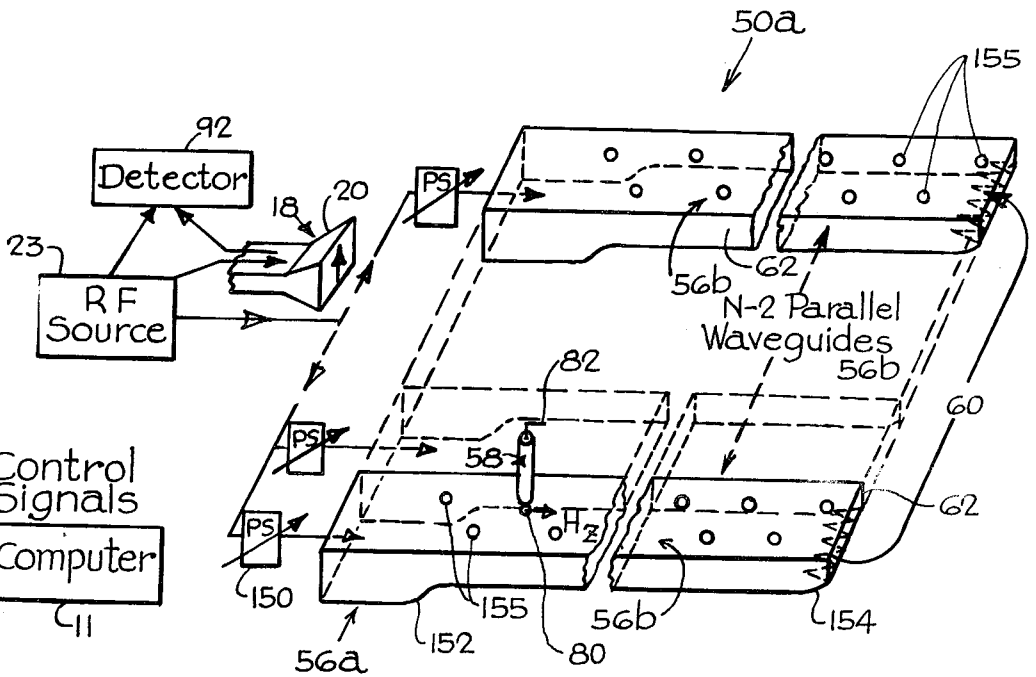
FIG. 8 is a diagrammatic perspective view of another modified embodiment, similar to the embodiment of FIG. 4.
Figure 9:
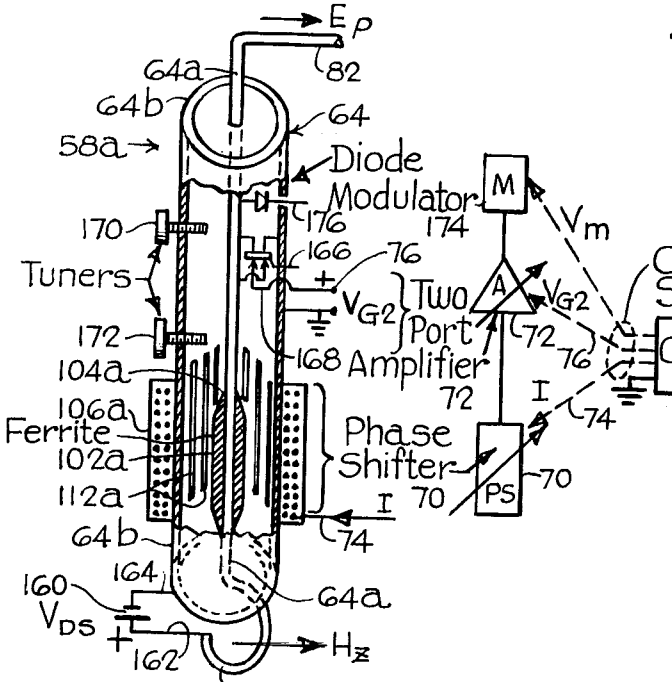
FIG. 9 is a diagrammatic perspective view showing additional details of the embodiment of FIG. 8.

FIGS. 8 and 9 illustrate a modified electronically controllable antenna **50*a* which is very similar in most respects to the antenna 50 of FIG. 4. The description applicable to FIG. 4 is also applicable to FIGS. 8 and 9, except as may be described differently below. In FIGS. 8 and 9, the same reference characters have been used as in FIG. 4**, to identify corresponding components.

FIG. 8 illustrates a slightly modified subsurface wave guide system **56*a* which is similar to the subsurface wave guide system of FIG. 4. The subsurface wave guide system 56*a* of FIG. 8 comprises several (N) parallel rectangular subsurface wave guides 56*b*, each of which may comprise a rectangular pipe or duct having walls made of conductive material. Each of the wave guides 56*b* is adapted to carry the dominant $TE_{10}$ wave guide mode. The two side wave guides 56*b* are illustrated in detail in FIG. 8 and it will be understood that there are N-2 wave guides between them. Each wave guide 56*b* is preferably terminated by a reflectionless absorber 60, as described in connection with FIG. 4. All of the subsurface wave guides 56*b* may be formed as a single wide rectangular pipe or duct, with the vertical longitudinal partitions 62 therein, as in FIG. 4, to form the individual wave guides 56*b***.

All N of the wave guides **56*b* are fed from the common radio frequency source 23, in such a manner that the total power is divided equally among them. Such power division is well known to those skilled in the art. The radio frequency power is preferably fed to the wave guides 56*b* through individually adjustable phase shifters 150, one of which is provided at the input to each wave guide 56*b*. By adjusting the phase shifters 150, the waves in all of the wave guides 56*b* can be given the same phase at their common input plane, which generally is desirable. The phase shifters 150 compensate for the differences in the phase paths from the radio frequency source 23 to the inputs of each of the wave guides 56*b*. In some cases, it may be desirable to shift the phase of the wave in each wave guide 56*b*** to a certain extent, relative to the phase in the neighboring wave guide, for the sake of additional control flexibility.

As shown in FIG. 6, as in FIG. 4, each subsurface wave guide **56*b* has a non-uniform cross section, in that each wave guide 56*b* has an intermediate portion 152 which tapers in its height or b dimension. Each wave guide 56*b* also tapers in its end portion 154, in which the reflectionless absorber 60 is mounted. This narrowing of each wave guide is an optional feature which suppresses the higher order modes, relative to the dominant mode. The suppression of the higher order modes is generally desirable, because there is a tendency for such higher order modes to be excited by the loop probes 80 which project into the wave guides 56*b* at the inputs of the coupling elements 58, as described in connection with FIG. 4, through openings 155**.

Each coupling element 58 may be the same as described in connection with FIG. 4. Alternatively, each coupling element may be modified slightly as described below in connection with FIG. 9.

In FIG. 8, as in FIG. 4, there are numerous coupling elements 58 and probes 80. As shown in FIG. 8, the probes 80 should be displaced in a symmetrical manner in both transverse directions from the central vertical plane of symmetry of each subsurface wave guide **56*b*, to provide effective coupling to the longitudinal magnetic field $H_Z$, which is an odd function with respect to such plane of symmetry, and is zero in the plane of symmetry. Due to the oddness of such function, the phases of the waves fed to alternate coupling elements 58 in each transverse row are 180° apart. The phase shifters 70 in the coupling elements 58 can be adjusted to compensate for this phase difference. The coupling elements 58 should be sufficiently numerous so that there will be several coupling elements per square wavelength, over the controllable surface 54 of the antenna 50 or 50*a* of FIG. 4 or 8**.

FIG. 9 illustrates a slightly modified coupling element **58*a* which is very similar in most respects to the coupling element 58 of FIGS. 4 and 8. Coupling elements like the modified coupling element 58*a* of FIG. 9 may be employed in place of the coupling elements 58 of FIGS. 4 and 8**.

As in the case of FIG. 4, the coupling element **58*a* of FIG. 9 comprises a wave guide section 64 made of conductive material and extending from the subsurface guiding structure 56 or 56*a* through an opening 66 in the surface means 54. The wave guide elements 64 deliver wave energy to the guided wave propagating above and within the dielectric layer 26 of the surface means 54**.

As before, the coupling element **58*a* incorporates electronically controllable amplification and phase shifting. Thus, the wave guide section 64 of FIG. 9 comprises an electronically controllable phase shifter 70 and an electronically controllable amplifier 72. Control lines 74 and 76 are provided between the computer 11 and the electronically controllable phase shifter 70 and amplifier 72** to supply control signals thereto.

As illustrated in FIG. 9, the wave guide section 64 is of the coaxial type comprising coaxial inner and outer cylindrical conductors **64*a* and *b*. A probe 80*a* is connected to the lower end of the central conductor 64*a*. As in the case of the probe 80, the probe 80*a* is of the loop-type, connected between the central conductor 64*a* and the outer conductor 64*b*, to provide effective coupling to the longitudinal magnetic field $H_Z$ in the corresponding subsurface wave guide 56*b***.

To provide a biasing voltage, $V_{DS}$, a voltage source 160 is connected in series with the loop 80*a*. Leads 162 and 164 are connected to the voltage source 160. The lead 162 is connected to the loop 80*a*, while the lead 164 is connected to the outer cylindrical conductor 64*b*. Due to capacitance between the leads 162 and 164, the loop 80*a* is essentially closed as to radio frequency energy.

The phase shifter 70 may be of any known or suitable construction. It is illustrated as being of the Reggia-Spencer type, the same as illustrated and described in connection with FIG. 6. Thus, the phase shifter 70 comprises the ferrite sleeve 102*a* adapted to be magnetized by the coil 106*a*, all as described in connection with FIG. 6. The slots 112*a* in the outer cylindrical conductor 64*b* are also the same as described in connection with FIG. 6. In this case, the control lead 74 from the computer 11 is connected to the end of the coil 106*a* to supply the phase shifter control current I to the coil.

In FIG. 9, the phase shifter 70 is disposed in and around the lower portion of the wave guide section 64. The radio frequency energy received by the loop 80*a* is phase shifted by the phase shifter 70 and then is supplied to the amplifier 72, which is disposed above the phase shifter.

The amplifier 72 of FIG. 9 may be of any known or suitable construction. The amplifier 72 may utilize negative resistance diodes or microwave transistors to provide amplification. However, as illustrated in FIG. 9, the amplifier 72 utilizes a dual gate GaAs MESFET transistor 166 having its source and drain terminals connected to the inner and outer conductors 64*a* and b of the coaxial wave guide 64. One gate of the dual gate transistor 166 is connected to the inner conductor 64*a*, while the connection to the other gate is brought out of the wave guide 64 by a lead 168.

The previously mentioned voltage source 160, connected between the loop 80*a* and the outer cylindrical conductor 64*b*, provides the drain-source biasing voltage $V_{DS}$ for the transistor 166. This voltage may be about 4 volts, for example.

The lead 168 may be connected to the control lead 76, which supplies the gate control voltage $V_{G2}$ from the computer 11. For the dual gate field effect transistor 166, the control voltage $V_{G2}$ may range from about $-2$ to $+2$ volts.

The leads to the transistor 166 all have a certain amount of inductive reactance which is utilized in tuning the device to the frequency of operation. Variable control over the tuning may be provided by tuning screws 170 and 172 threaded through the outer cylindrical conductor 64*b* of the wave guide 64. The tuning screws 170 and 172 may be disposed opposite the inner conductor 64*a* at points above and below the transistor 166. The screws are appropriately located and adjusted to provide the desired tuning. Any other known or suitable tuning means may be provided.

As in FIG. 4, the coupling element 58*a* of FIG. 9 is provided with a probe 82, connected to the upper end of the inner cylindrical conductor 64*a*. The output of the amplifier 72 is effectively fed to the probe 82 and is combined with the guided wave which is propagating along the surface means 54.

The dual gate MESFET transistor 166 provides many advantages as a microwave amplifier. The forward gain of the amplifier can be adjusted between about $-25$ and $+18$ dB, depending upon the control voltage $V_{G2}$. Thus, the amplifier can be operated as either an attenuator or an amplifier.

The transistor amplifier has a linear power gain. Moreover, the amplifier has a relatively low noise figure.

The transistor amplifier is capable of very fast response. Thus, the amplifier can be switched between high gain and high attenuation in a radio frequency cycle at about 10 GHz.

The transistor amplifier provides stable reverse isolation of the order of about 25 dB, so that it is possible to eliminate the need for the isolator 78 of FIG. 4. Accordingly, the isolator 78 is not employed as a separate element in the coupling element 58*a* of FIG. 9.

The transistor amplifier can be operated at extremely high microwave frequencies, at least as high as the X-band, 8.2–12.4 GHz. In the near future, improved transistors should be available for operation at much higher frequencies. The transistor amplifier can handle an output power of the order of 0.5 watt, which is considerably more than the power handling capabilities of bipolar transistors.

The properties of the dual gate MESFET, when used as a radio frequency amplifier, were reported at the 1974 meeting of the IEEE Society for Microwave Theory and Techniques International Microwave Symposium. Developments relating to such transistors were reported in the issue of the magazine MICROWAVES for April 1975, pages 11 and 12.

The coupling element 58*a* of FIG. 9 comprises a modulator utilizing a diode 174 having one terminal connected to the inner conductor 64*a*, while the other terminal of the diode 174 is brought out of the wave guide section 64 by a lead 176, which may be supplied with a modulating voltage $V_m$ from the computer 11. By changing the modulating voltage, the diode 174 can be switched between ON (shorted) and OFF (open) states. This amplitude modulation performs the function of creating a back-scattered wave which propagates back along the antenna surface 54 to the wave guide horn 20 and is coherently detected in the detector 92, in the antenna 50*a* of FIG. 8, or the antenna 50 of FIG. 4. When any particular coupling element 58*a* is being modulated, its amplifier 72 is turned OFF, by driving the control voltage $V_{G2}$ negative, so as to switch the amplifier transistor 166 into the role of an attenuator, thus isolating the subsurface magnetic field probe 80*a* from the upper probe 82. The signal detected by the coherent detector 92 is in proportion to $E_\rho^2$ at the position of the probe 82 for the particular coupling element 58*a* which is being modulated. This is true in both amplitude and phase. By modulating each coupling element 58*a* in turn, the field distribution over the entire surface 54 can be measured. The modulating voltage $V_m$ from the computer 11 should ordinarily be a square wave of a few volts amplitude and in the upper audio frequency range.

When the modulator diode 174 is not in use, it can readily be inactivated by switching the modulation voltage $V_m$ to a constant negative value to provide a reverse bias which causes the diode 174 to be nonconductive. Thus, the diode is an open circuit and has essentially no effect. The amplifier control voltage $V_{G2}$ is varied to control the gain of the amplifier 72.

The modulator voltage $V_m$ is varied above and below the bias voltage $V_{DS}$ which is applied to the inner conductor 64*a* of the wave guide section 64.

The description applicable to FIG. 4 is also applicable to FIGS. 8 and 9, except as differently described above.

It should be noted that the detector 94 of FIG. 4 is not used if the diode modulator 174 of FIG. 9 is used.

I claim:

1. An electronically variable guided wave antenna, comprising antenna surface means capable of supporting a radio frequency guided wave along said surface means, launching means directed along and generally parallel with said antenna surface means for launching a radio frequency guided wave along said antenna surface means, said antenna surface means comprising electronically controllable surface impedance means distributed over said surface means and including first control signal responsive means for varying the real magnitude component of the surface impedance presented to said guided wave over said surface means in a non-uniform manner, said surface impedance means also including second control signal responsive means for separately varying the phase angle of the surface impedance presented to said guided wave over said surface means in a non-uniform manner, and control means for supplying individual control signals to said first and second control signal responsive means to vary the propagation characteristics and the directional radiation pattern of said guided wave antenna, said electronically controllable surface impedance means comprising an array of closely spaced discrete electronically controllable surface impedance elements distributed over said surface means, said array of discrete electronically controllable surface impedance elements comprising an array of wave guide elements leading from said surface means and including electronically variable means incorporating said first and second control signal responsive means, said electronically variable means including a reflection amplifier having a single port connected to the corresponding wave guide element, said amplifier comprising said first control signal responsive means operative to vary the amplification characteristics of said amplifier and said second control signal responsive means operative to vary the phase characteristics of said amplifier.

2. An electronically variable guided wave antenna, comprising antenna surface means capable of supporting a radio frequency guided wave along said surface means, launching means directed along and generally parallel with said antenna surface means for launching a radio frequency guided wave along said antenna surface means, said antenna surface means comprising electronically controllable surface impedance means distributed over said surface means and including first control signal responsive means for varying the real magnitude component of the surface impedance presented to said guided wave over said surface means in a non-uniform manner, said surface impedance means also including second control signal responsive means for separately varying the phase angle of the surface impedance presented to said guided wave over said surface means in a non-uniform manner, and control means for supplying individual control signals to said first and second control signal responsive means to vary the propagation characteristics and the directional radiation pattern of said guided wave antenna, said electronically controllable surface impedance means comprising an array of closely spaced discrete electronically controllable surface impedance elements distributed over said surface means, said array of discrete electronically controllable surface impedance elements comprising an array of wave guide elements leading from said surface means and including electronically variable means incorporating said first and second control signal responsive means, said electronically variable means comprising a reflection amplifier connected to the corresponding wave guide element and having a plurality of control signal inputs for varying the gain and phase of the signal reflected from said amplifier.

3. An electronically variable guided wave antenna, comprising antenna surface means capable of supporting a radio frequency guided wave along said surface means, and launching means directed along and generally parallel with said antenna surface means for launching a radio frequency guided wave along said antenna surface means, said antenna surface means comprising electronically controllable surface impedance means distributed over said surface means and including first control signal responsive means for varying the real magnitude component of the surface impedance presented to said guided wave over said surface means in a non-uniform manner, said surface impedance means also including second control signal responsive means for separately varying the phase angle of the surface impedance presented to said guided wave over said surface means in a non-uniform manner, said first and second control signal responsive means being operative to vary the propagation characteristics and the directional radiation pattern of said guided wave antenna, said electronically controllable surface impedance means comprising an array of electronically controllable elements distributed over said surface means for supplying additional wave energy to said guided wave as it is propagated along said surface means, said first and second control signal responsive means being operative to vary the magnitude and phase of said additional wave energy, said electronically controllable elements including reflection amplifier means for deriving energy from the wave traveling over said surface means, amplifying such energy and returning the amplified energy to said guided wave, said reflection amplifier means including said first and second control signal responsive means operative to vary both the amplitude and phase of the amplified energy.

4. An electronically variable guided wave antenna, comprising antenna surface means capable of supporting a radio frequency guided wave along said surface means, launching means directed along and generally parallel with said antenna surface means for launching a radio frequency guided wave along said antenna surface means, said antenna surface means comprising electronically controllable surface impedance means distributed over said surface means and including first control signal responsive means for varying the real magnitude component of the surface impedance presented to said guided wave over said surface means in a non-uniform manner, said surface impedance means also including second control signal responsive means for separately varying the phase angle of the surface impedance presented to said guided wave over said surface means in a non-uniform manner, and control means for supplying individual control signals to said first and second control signal responsive means to vary the propagation characteristics and the directional radiation pattern of said guided wave antenna, said antenna including terminating surface means for causing radiation of the remainder of the guided wave after passing over said antenna surface means.

5. An antenna according to claim 4, in which said terminating surface means has a surface impedance approaching zero.

6. An electronically variable guided wave antenna, comprising antenna surface means capable of supporting a radio frequency guided wave along said surface means, and launching means directed along and generally parallel with said antenna surface means for launching a radio frequency guided wave along said antenna surface means, said antenna surface means comprising electronically controllable surface impedance means distributed over said surface means and including first control signal responsive means for varying the real magnitude component of the surface impedance presented to said guided wave over said surface means in a non-uniform manner, said surface impedance means also including second control signal responsive means for separately varying the phase angle of the surface impedance presented to said guided wave over said surface means in a non-uniform manner, said first and second control signal responsive means being operative to vary the propagation characteristics and the directional radiation pattern of said guided wave antenna, said electronically controllable surface impedance means comprising an array of closely spaced discrete electronically controllable surface impedance elements distributed over said surface means, said impedance elements including electronically controllable amplifiers and electronically controllable phase shifters, said antenna including modulator means for selectively modulating said impedance elements, said antenna including coherent detector means connected to said launching means for detecting back-scattered waves modulated by said modulator means.

7. An electronically variable guided wave antenna, comprising antenna surface means capable of supporting a guided wave along said antenna surface means, said antenna surface means comprising a plurality of electronically controllable elements distributed on said antenna surface means for supplying guided wave energy to said surface means, said elements being oriented to direct said guided wave energy along and generally parallel to said antenna surface means, each of said electronically controllable elements including control signal responsive means for varying both the magnitude and phase of the guided wave energy supplied by said electronically controllable element to vary the directional radiation pattern of said guided wave antenna, each of said electronically controllable elements including a modulator for modulating said guided wave energy, said antenna including a coherent detector along said antenna for detecting back-scattered waves modulated by said modulator.

8. An electronically variable guided wave antenna, comprising antenna surface means capable of supporting a guided wave along said antenna surface means, said antenna surface means comprising energy conveyance means including a plurality of electronically controllable coupling elements distributed over said antenna surface means for interchanging radio frequency energy and guided wave energy, said coupling elements being oriented to couple with guided wave energy directed along and generally parallel with said antenna surface means, said electronically controllable coupling elements including control signal responsive means for varying both the amplitude and phase of the radio frequency energy to vary the directional radiation pattern of the antenna, each of said coupling elements including a selectively operable modulator, said antenna including a coherent detector along said antenna for detecting waves modulated by said modulator.

9. An electronically variable guided wave antenna, comprising reactive antenna surface means capable of supporting a radio frequency guided wave along said surface means, reciprocal launching means directed in a launch direction along and generally parallel with said antenna surface means for launching a radio frequency guided wave along said antenna surface means, said antenna surface means comprising a multiplicity of electronically controllable surface impedance elements distributed in two dimensions both parallel and transversely to said launch direction over said surface means, each of said surface impedance elements including control signal responsive means for varying the surface impedance presented to said guided wave over such surface impedance element, and control means for supplying individual control signals to said control signal responsive means for varying the propagation characteristics and the directional radiation pattern of said guided wave antenna, said surface impedance elements comprising an array of wave guide elements leading from said surface means, each of said wave guide elements including a reflection amplifier having a single port connected to the corresponding wave guide element, said reflection amplifier incorporating said control signal responsive means, said control signal responsive means including first means for varying the amplification characteristics of said reflection amplifier, and second means for varying the phase characteristics of said reflection amplifier.

10. An electronically variable guided wave antenna, comprising antenna surface means capable of supporting a radio frequency guided wave along said surface means, reciprocal launching means directed in a launch direction along and parallel with said antenna surface means for launching a radio frequency guided wave along said antenna surface means, said antenna surface means having a portion with an inductive surface impedance adjacent said launching means for supporting the propagation of the guided wave along said antenna surface means, said antenna surface means comprising a multiplicity of electronically controllable surface impedance elements distributed in two dimensions both parallel and transversely to said launch direction over said surface means, each of said surface impedance elements including control signal responsive means for varying the surface impedance presented to said guided wave over such surface impedance element, control means for supplying individual control signals to said control signal responsive means for varying the propagation characteristics and the directional radiation pattern of said guided wave antenna, and terminating surface means for causing the radiation of the guided wave after it passes over said antenna surface means.

11. An electronically variable guided wave antenna according to claim 10, in which said terminating surface means has a surface impedance approaching zero.

12. An electronically variable guided wave antenna, comprising antenna surface means capable of supporting a radio frequency guided wave along said surface means, launching means directed along and parallel with said antenna surface means for launching a radio frequency guided wave along said antenna surface means, said antenna surface means having a portion with inductive surface impedance for supporting the propagation of the guided wave along said antenna surface means, said antenna surface means comprising electronically controllable surface impedance means distributed over said surface means and including first control signal responsive means for varying the real magnitude component of the surface impedance presented to said guided wave over said surface means in a non-uniform manner, said surface impedance means also including second control signal responsive means for separately varying the phase angle of the surface impedance presented to said guided wave over said surface means in a non-uniform manner, and control means for supplying individual control signals to said first and second control signal responsive means to vary the propagation characteristics and the directional radiation pattern of said guided wave antenna, said portion with inductive surface impedance including an initial antenna surface adjacent said launching means and comprising an electrically conductive surface member and a solid dielectric surface member surmounting said electrically conductive surface member.

13. An electronically variable guided wave antenna, comprising antenna surface means capable of supporting a radio frequency guided wave along said surface means, reciprocal launching means directed in a launch direction along and parallel with said antenna surface means for launching a radio frequency guided wave along said antenna surface means, said antenna surface means having a portion with an inductive surface impedance adjacent said launching means for supporting the propagation of the guided wave along said antenna surface means, said antenna surface means comprising a multiplicity of electronically controllable surface impedance elements distributed in two dimensions both parallel and transversely to said launch direction over said surface means, each of said surface impedance elements including control signal responsive means for varying the surface impedance presented to said guided wave over such surface impedance element, and control means for supplying individual control signals to said control signal responsive means for varying the propagation characteristics and the directional radiation pattern of said guided wave antenna, said portion with inductive surface impedance including an initial antenna surface adjacent said launching means and comprising an electrically conductive surface member and a solid dielectric surface member surmounting said electrically conductive surface member.

14. An electronically variable guided wave antenna, comprising antenna surface means capable of supporting a guided wave along and parallel with said antenna surface means, said antenna surface means having at least a portion with an inductive surface impedance for supporting the propagation of the guided wave along said antenna surface means, said antenna surface means having a multiplicity of electronically controllable elements distributed over said antenna surface means in two dimensions which are transversely related to each other for supplying guided wave energy to said antenna surface means, said electronically controllable elements being oriented to direct said guided wave energy along and parallel to said antenna surface means, each of said electronically controllable elements including control signal responsive means for varying the guided wave energy supplied by said electronically controllable element to said antenna surface means, and control means for supplying individual control signals to said control signal responsive means for varying the directional radiation pattern of said guided wave antenna, said portion with an inductive surface impedance including electrically conductive surface means and solid dielectric surface means surmounting said electrically conductive surface means.

15. An electronically variable guided wave antenna, comprising antenna surface means capable of supporting a radio frequency guided wave along said surface means, launching means directed along and substantially parallel with said antenna surface means for launching a radio frequency guided wave along said antenna surface means, said antenna surface means comprising electronically controllable surface impedance means distributed over said surface means and including first control signal responsive means for varying the real magnitude component of the surface impedance presented to said guided wave over said surface means in a non-uniform manner, said surface impedance means also including second control signal responsive means for separately varying the phase angle of the surface impedance presented to said guided wave over said surface means in a non-uniform manner, and control means for supplying individual control signals to said first and second control signal responsive means to vary the propagation characteristics and the directional radiation pattern of said guided wave antenna, said electronically controllable surface impedance means comprising an array of closely spaced discrete electronically controllable surface impedance elements distributed over said surface means, said array of discrete electronically controllable surface impedance elements comprising an array of wave guide elements leading from said surface means and including electronically variable means incorporating said first and second control signal responsive means, said electronically variable means including means including a reflection amplifier connected to the corresponding wave guide element for reflecting wave energy along said wave guide element, said amplifier comprising said first control signal responsive means operative to vary the amplification characteristics of said reflection amplifier, said electronically variable means including said second signal responsive means for varying the phase of the wave energy reflected along said wave guide element.

16. An electronically variable guided wave antenna, comprising reactive antenna surface means capable of supporting a radio frequency guided wave along said surface means, reciprocal launching means directed in a launch direction along and substantially parallel with said antenna surface means for launching a radio frequency guided wave along said antenna surface means, said antenna surface means comprising a multiplicity of electronically controllable surface impedance elements distributed in two dimensions both parallel and transversely to said launch direction over said surface means, each of said surface impedance elements including control signal responsive means for varying the surface impedance presented to said guided wave over such surface impedance element, and control means for supplying individual control signals to said control signal responsive means for varying the propagation characteristics and the directional radiation pattern of said guided wave antenna, said surface impedance elements comprising an array of wave guide elements leading from said surface means, each of said wave guide elements including means including a reflection amplifier connected to the corresponding wave guide element for reflecting wave energy along said wave guide element, said control signal responsive means including first means for varying the amplification characteristics of said reflection amplifier, and second means for varying the phase of the wave energy reflected along said wave guide element.

* * * * *

UNITED STATES PATENT OFFICE

CERTIFICATE OF CORRECTION

Patent No. 4,150,382 Dated April 17, 1979

Inventor(s) Ray J. King

It is certified that error appears in the above-identified patent and that said Letters Patent are hereby corrected as shown below:

In Column 2, line 42, "applied" should be -- supplied --

In Column 4, line 37, "$Y_s = + H_\rho/H_\phi$" should be -- $Y_s = + H_\rho/E_\phi$ --

In Column 5, line 10, "relected" should be -- reflected --

In Column 17, line 2, "$E_{92}$" should be -- $E_\rho$ --

In Column 17, line 31, "$E_{92}$" should be -- $E_\rho$ --

In Column 18, line 8, "FIG." should be -- In FIG. --

In Column 19, line 26, "$H_{92}$" should be -- $H_\rho$ --

Signed and Sealed this

*Twenty-first* Day of *August 1979*

[SEAL]

*Attest:*

*Attesting Officer*

LUTRELLE F. PARKER

*Acting Commissioner of Patents and Trademarks*